US006893013B2

(12) United States Patent
Spitz et al.

(10) Patent No.: US 6,893,013 B2
(45) Date of Patent: May 17, 2005

(54) INPUT TRAY MECHANICAL BLOCKING APPARATUS

(75) Inventors: Donald N. Spitz, Lexington, KY (US); Gregory P. Washnock, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 198 days.

(21) Appl. No.: 10/330,505

(22) Filed: Dec. 27, 2002

(65) Prior Publication Data

US 2004/0124576 A1 Jul. 1, 2004

(51) Int. Cl.[7] ..... B65H 3/34
(52) U.S. Cl. ..... 271/104; 271/167; 271/122
(58) Field of Search ..... 271/104, 122, 271/143, 167

(56) References Cited

U.S. PATENT DOCUMENTS 3,403,903 A * 10/1968 Caril ..... 271/20
6,065,886 A * 5/2000 Embry et al. ..... 400/629
6,390,463 B1 5/2002 Iwago
6,392,763 B1 5/2002 Nishinohara et al.
6,398,214 B1 6/2002 Moteki et al.
6,409,043 B1 6/2002 Fujita et al.
6,409,165 B1 6/2002 Yamaoka et al.
6,422,554 B1 7/2002 Wuethrich et al.
6,523,820 B2 * 2/2003 Gustafson et al. ..... 271/10.01
6,598,873 B2 * 7/2003 Takisawa et al. ..... 271/246

* cited by examiner

*Primary Examiner*—Donald P. Walsh
*Assistant Examiner*—Kaitlin Joerger
(74) *Attorney, Agent, or Firm*—Todd T. Taylor (Taylor & Aust)

(57) ABSTRACT

A media block system for the input tray of a media processing device. A barricade is provided in the input tray and is movable between blocking and retracted positions. The barricade is moved by an arm and a lever connected to a feed roll shaft whereby rotation of the feed roll shaft moves the barricade.

20 Claims, 3 Drawing Sheets

INPUT TRAY MECHANICAL BLOCKING APPARATUS

BACKGROUND OF THE INVENTION

1. Field of the Invention

The present invention relates generally to automatic document feeders in media processing devices, and, more particularly, to media stack positioning mechanisms in input trays of automatic document feeders.

2. Description of the Related Art

Media handling devices such as laser or ink jet printers, scanners, copiers, fax machines, ATM machines and the like utilize many different types of pick mechanisms to deliver individual sheets of media to a delivery or indexing system of the device. It is known to load the media as a stack into an input tray before the individual pieces of media are fed to the system. A single piece of media is removed from the stack when processing occurs. In all such devices, the media must be fed reliably, one sheet at a time, each time a processing job occurs.

Both vertical and horizontal pick mechanism and media feed designs are known. Vertical mechanisms rely on both the user positioning of the stack in the input tray and gravity to bring the media stack to proper location in the input tray. Horizontal mechanism designs rely more exclusively on user positioning for proper orientation and placement of the media stack in the input tray. Some horizontal pick mechanisms have removable trays so that the user can visually recognize the proper position for the stack, and place the stack of media accordingly. Other horizontal designs do not employ removable trays, and the media stack is inserted into a fixed input tray area.

Proper and consistent positioning of the media stack in the input tray is essential to subsequent performance of the pick mechanism. Even after the stack of media has been positioned properly, it is important for all pieces of media to remain properly positioned, even as individual pieces are removed. If the stack of media is improperly positioned in the input tray, either initially or as individual pieces are removed, media-feeding failure can result. Improper feeding can cause media jams, skew of the media being delivered, or double and multiple picks of media from the input tray.

In both vertical and horizontal automatic document feeders it is known to use "block" mechanisms to aid in proper positioning of the media stack in the input tray. A block mechanism typically creates resistance to the insertion of the media stack, thereby providing positive feed back to the device user that the media is installed in a specific position. In vertical input trays, in which gravity can be used for final positioning, the block mechanism can be somewhat subtle, relying on the stack to settle into its final position under the influence of gravity, even after the user has released the stack. However, in horizontal input trays the block mechanism needs to provide an immediate, clear indication that the final media stack position has been reached. The user must not be tempted to terminate insertion too early, leaving the stack position short of the intended position, and must clearly be aware if the stack has been inserted too far.

Especially for horizontally oriented input trays, an advantageously designed media block apparatus, therefore, should fulfill two basic objectives. The block apparatus should convey a positive message to the user that the media stack is properly positioned, by providing a consistent and firm stopping location for media inserted into the input tray.

Further, the block apparatus should maintain that position for the media stack relatively constantly as each sheet is removed from the tray and feed into the processing apparatus.

What is needed in the art is a simple, reliable and robust blocking mechanism that ensures proper stack positioning in a horizontal media input tray of a media processing device.

SUMMARY OF THE INVENTION

The present invention provides a media block apparatus for a fixed horizontal input tray of a processing device that provides consistent positioning for the media stack without interference for subsequent individual media picking operations.

The invention provides, in one form thereof, an automatic document feeder for a media processing device. The automatic document feeder has a feed roll assembly including a feed roll shaft and feed rolls thereon, a media input tray for holding media to be printed, the input tray having a discharge end from which media held therein is removed for processing, and a media block apparatus. The block apparatus includes a media block having a barricade operable in the input tray and selectively positionable in blocking and retracted positions. A block lever is drivingly connected to the feed roll assembly and engaged with the media block for moving the barricade between the blocking and retracted positions.

The invention comprises, in another form thereof, a media blocking apparatus for an input tray of an automatic document feeder in a processing device, the document feeder including a feed roll on a feed roll shaft. The blocking apparatus has a media block operable in the input tray. The media block is adapted for movement between blocking and retracted positions in the tray. A block lever is drivingly connected to the feed roll and the media block for moving the media block between the blocking and retracted positions.

The invention comprises, in still another form thereof, a media block apparatus for a processing device having an automatic document feeder with a media input tray and a feed roll shaft. A barricade in the input tray inhibits insertion of media in the tray beyond the barricade. A drive connection between the barricade and the feed roll shaft moves the barricade between blocking and retracted positions upon rotation of the feed roll shaft.

The invention comprises, in yet another form thereof, a processing device with a document feeder including a media input tray and a feed roll assembly. A media block apparatus includes a barricade adapted and arranged in the input try to move between blocking and retracted positions; and drive connection between the barricade and the feed roll assembly for moving the barricade between the blocking and retracted positions by rotation of the feed roll assembly.

An advantage of the present invention is providing a simple, yet robust blocking mechanism for positioning media in a horizontal media tray of a processing device.

Another advantage of the present invention is providing a blocking mechanism for a fixed horizontal media input tray of a processing device that adds a minimal number of additional parts to an automatic document feeder, thereby having minimal part position variation due to tolerance stack-up.

Still anther advantage of the present invention is providing a blocking mechanism for a media tray that provides positive feedback to a user that the media stack is properly positioned, and that maintains the proper position of the media stack as each individual piece of media is removed from the tray.

Yet another advantage is providing a media block apparatus for a media input tray of an automatic document feeder that functions independent of a pick mechanism for the document feeder, and that therefore can be used with different types of pick mechanisms.

BRIEF DESCRIPTION OF THE DRAWINGS

The above-mentioned and other features and advantages of this invention, and the manner of attaining them, will become more apparent, and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
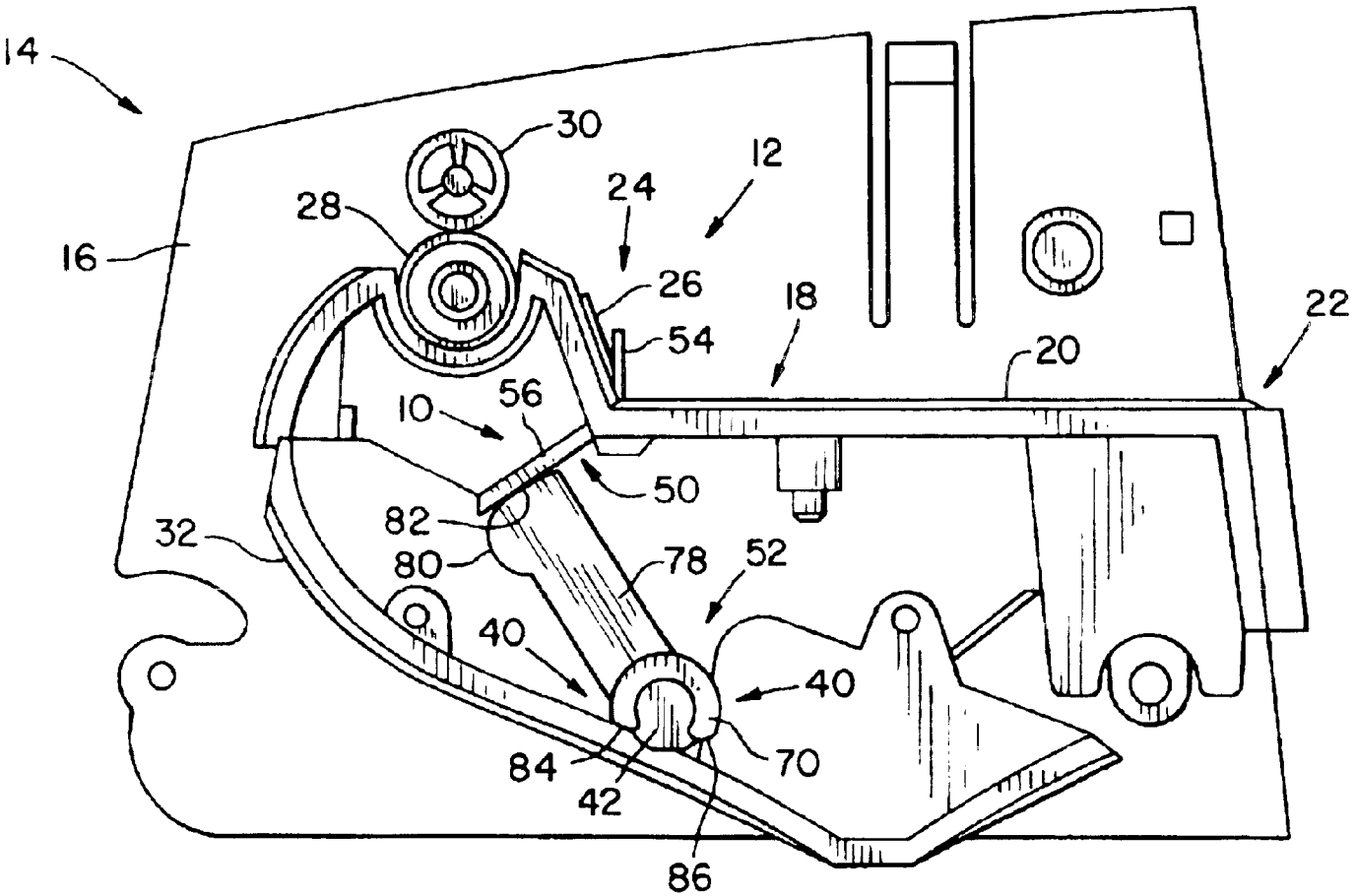
FIG. 1 is a side elevational view of a processing device having a media block apparatus in accordance with the present invention.

Referring now more specifically to the drawings, and to FIG. 1 in particular, a media block apparatus 10 in accordance with the present invention is shown in an automatic document feeder 12 of a media processing device 14. Media block apparatus 10 of the present invention can be used in various different media processing devices 14 including, but not limited to scanners, copiers, printers of various types, fax machines, ATM machines and other processing devices in which media is provided in a stack, from which individual pieces of media are delivered singly to a downstream processing station, such as a printing or scanning station. The exemplary processing device 14 illustrated in the drawings is only one example of a suitable processing device in which the present invention can be used advantageously.

Processing device 14 includes a frame 16 that contains automatic document feeder 12, as well as other subsystems (not shown) of processing device 14, such as, for example, a scanning station or a printing station.

Automatic document feeder 12 includes a horizontal media input tray 18, which may be integral with frame 16. During use of processing device 14, a stack of media (not shown) is placed in input tray 18, and individual pieces of media are removed, one by one, and supplied via automatic document feeder 12 to the other subsystems (not shown) of processing device 14. Those skilled in the art will readily understand that automatic document feeder 12 includes a pick mechanism (not shown) closely associated with input tray 18, such that individual sheets of media are removed from input tray 18 and supplied to the subsequent systems. An advantage of the present invention is that media block apparatus 10 is independent of the pick mechanism (not shown) and therefore can be used with a variety of different pick mechanisms.

Input tray 18 includes a substantially horizontal support surface 20 extending between a receiving end 22 at which a stack of media is inserted into tray 18 and a discharge end 24 from which individual pieces of media are removed and supplied via automatic document feeder 12 for processing in device 14. A paper dam or dams 26 are provided at discharge end 24. Those skilled in the art will understand the purpose for and operation of paper dam 26 in providing an angular surface against which individual pieces of media climb for separation as the individual pieces of media are removed from input tray 18 by a pick mechanism (not shown).

Figure 4:
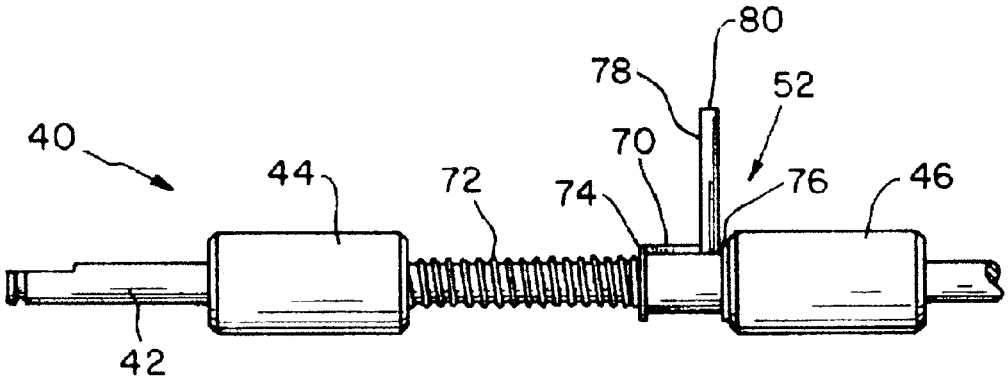
FIG. 4 is a side view of a feed roll assembly including a portion of the block apparatus of the present invention.

Automatic document feeder 12 further includes a delivery roll 28, an idler roll 30 and down guides 32 defining a media path along which individual pieces of media are directed from input tray 18 through automatic document feeder 12 for processing within device 14. A feed roll assembly 40 is provided as part of the media path defined through automatic document feeder 12, and is positioned below input tray 18, generally near discharge end 24 thereof. As can be seen most clearly in FIG. 4, feed roll assembly 40 includes a feed roll shaft 42 and a plurality of feed rolls 44, 46, two such feed rolls 44 and 46 being shown in FIG. 4. Those skilled in the art will readily understand that feed roll assembly 40 will commonly include yet another feed roll spaced from a center feed roll 46 by a distance similar to the distance between feed roll 44 and center feed roll 46.

Media block apparatus 10 is provided to establish a stop or abutment for media inserted into input tray 18. Media block apparatus 10 operates a minimal distance in front of paper dam 26, so that the media is not inserted too far, which can result in improper or inconsistent feed of the media, particularly if bundles or groups of media are forced against paper dam 26 so that proper separation of the media does not occur.

Media block apparatus 10 includes a media block 50 extending from below input tray 18 to above input tray support surface 20, near discharge end 24 thereof. A media block lever 52 is provided below media input tray 18 and is drivingly connected to feed roll shaft 42 and operates media block 50.

Figure 2:
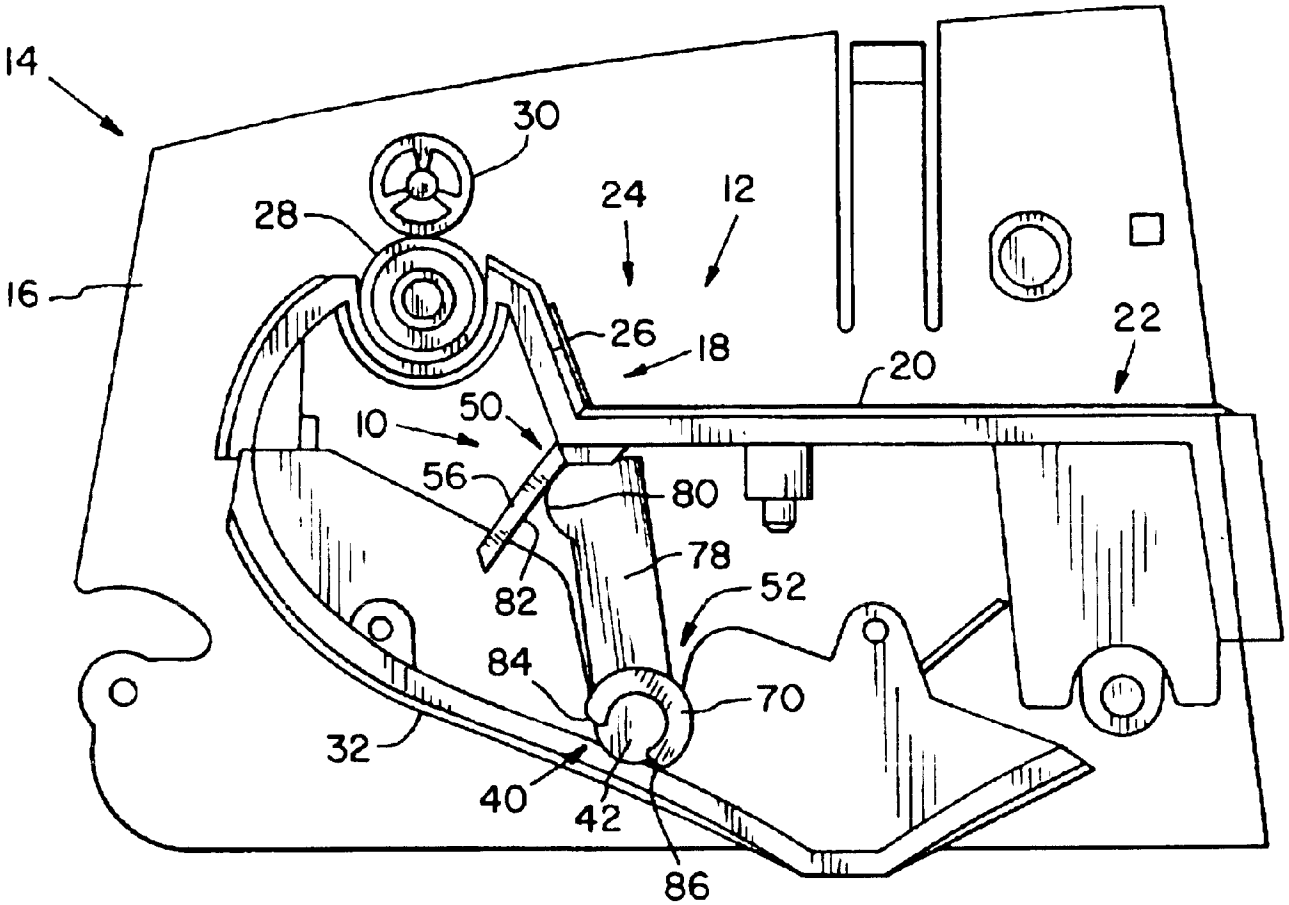
FIG. 2 is a side elevational view of the processing device shown in FIG. 1, but illustrating the media block apparatus in a state of operation different from that shown in FIG. 1.
Figure 3:
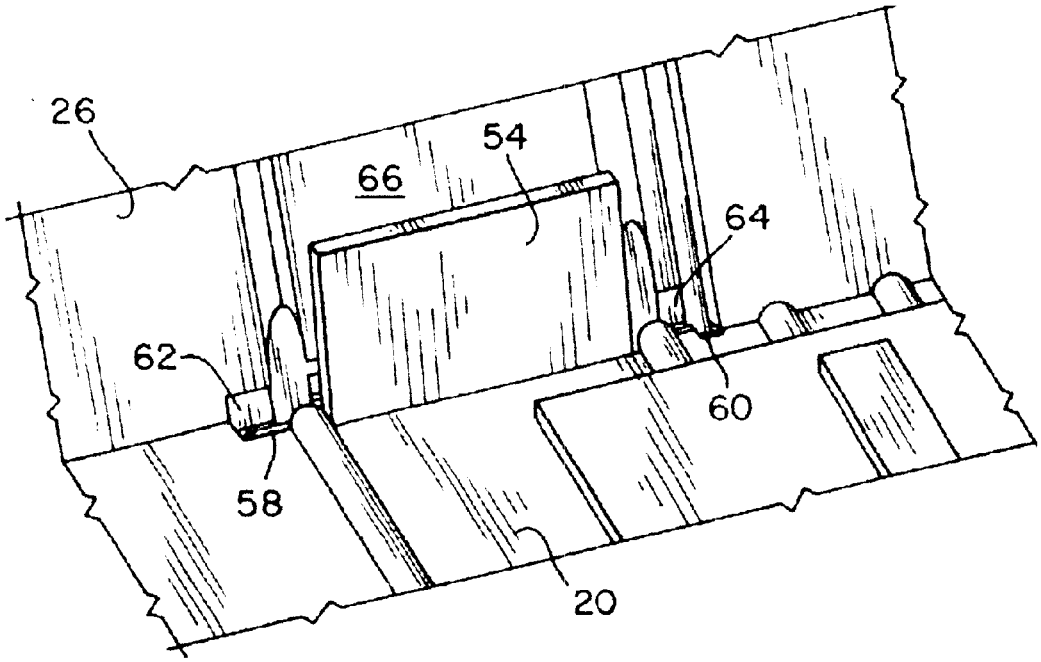
FIG. 3 is an enlarged perspective view of a portion of the processing device, showing the media block apparatus of the present invention in an input tray.

Media block 50 includes a barricade 54 and an arm 56 angularly connected to each other, as seen most clearly in FIGS. 1 and 2. Barricade 54 is a flat plate extending upwardly of support surface 20. Pivots 58 and 60 (FIG. 3) are provided at opposite sides of barricade 54. Pivots 58 and 60 are received in slots 62 and 64, respectively, defined in input tray 18, such that media block 50 can pivot freely on pivots 58 and 60 relative to support surface 20 and paper dam 26. Media block 50, and specifically barricade 54 thereof, is rotatable on pivots 58 and 60 between a blocking position of barricade 54 shown in FIG. 1 and a retracted position for barricade 54 shown in FIG. 2. A recess 66 is provided in paper dam 26, defining an area for receiving barricade 54 in the retracted position, such that, when retracted, barricade 54 does not interfere with media contacting and climbing paper dam 26. For consistency in media placement, it is preferred that barricade 54 is positioned near the center of the width of input tray 18 at discharge end 24.

Lever 52 is drivingly connected to feed roll shaft 42, and includes a C-shaped collar 70 partially surrounding feed roll shaft 42. As seen most clearly in FIG. 4, lever 52, and particularly collar 70 thereof, is positioned on feed roll shaft 42 between adjacent feed rolls 44 and 46. A spring 72 is provided on shaft 42, between feed roll 44 and collar 70, and is of sufficient length to urge collar 70 toward feed roll 46. Washers 74 and 76 are provided on shaft 42, against opposite sides of collar 70. In the assembled arrangement, collar 70 and washers 74 and 76 are biased toward feed roll 46 by spring 72. Held in this manner, lever 52 tends to turn with feed roll shaft 42, unless and until a resistance to turning is encountered sufficient to overcome the normal force applied to collar 70 by spring 72. Physical characteristics of washers 74 and 76, such as material, surface finish, thickness and the like can be selected along with the spring characteristics of spring 72 to achieve the desired effect from spring 72.

Lever 52 further includes a leg 78 extending outwardly of collar 70 and defining a cam surface 80 at a distal end of leg 78. A surface of arm 56 defines a cam follower 82 of arm 56. The lengths and weights of barricade 54 and arm 56 are selected, together with the positioning of pivots 58 and 60, to place the center of gravity of media block 50 behind pivots 58 and 60. Therefore, gravity rotates media block 50 on pivots 58 and 60 to maintain contact between cam follower 82 and cam surface 80.

As those skilled in the art will readily understand, it is known to operate automatic document feeder 12 in both forward and reverse directions. With reference to the embodiment illustrated in the drawings, and as shown in FIGS. 1 and 2, a drive mechanism (not shown) rotates feed roll assembly 40 in a clockwise direction during which media pick and delivery systems (not shown) are activated, and in an opposite, counterclockwise direction during which the media pick and delivery systems are deactivated.

During operation of device 14, media block apparatus 10 experiences three operating conditions, an idle condition between media feeds, during which media insertion may occur, a media pick and delivery condition and a media feed and exit condition.

During the idle condition, media insertion may occur. Since the idle condition follows an operation in which a sheet of media has been transported through automatic document feeder 12, automatic document feeder 12 will have ended its previous operation on a forward rotation of the motor (not shown). Forward motion of automatic document feeder 12 rotates feed roll assembly 40, and thereby lever 52 in a counterclockwise direction, with respect to the view shown in FIGS. 1 and 2. Rotation of block lever 52 in a counterclockwise direction as illustrated in FIG. 1 results in a clockwise rotation of media block 50 about pivots 58 and 60, as cam follower 82 of arm 56 rides along cam surface 80 of leg 78. Media block lever 52 continues to rotate with feed roll shaft 42 until a first edge 84 of C-shaped collar 70 contacts down guides 32 or other fixed structure in automatic document feeder 12. When edge 84 of collar 70 contacts down guide 32, further rotation of block lever 52 stops. The resistive force of contact with down guide 32 is greater than the drive force caused by the normal force of block spring 72 in the assembled drive arrangement of media block apparatus 10 on feed roll shaft 42, inhibiting further rotation of lever 52. This condition is illustrated in FIG. 1.

In the position of barricade 54 illustrated in FIG. 1, which is referred to herein as the blocking position, insertion of media into input tray 18 can occur, with the leading edge of the media eventually contacting barricade 54. Barricade 54 will be provided advantageously at substantial right angles to support surface 20, or, from pivots 58 and 60, barricade 54 may angle slightly rearwardly, that is angling toward receiving end 22 of input tray 18. As media is inserted into input tray 18, the individual inserting the media experiences a firm stop position past which further insertion of media is prevented. Depending on the physical properties of the media being loaded into input tray 18, as a result of the blunt engagement against barricade 54, the media may buckle rearwardly of barricade 54. This provides a strong visual indication to the user that further insertion force should not be applied on the stack of media.

During the idle condition, media block 50 stays in the blocking position even as media is inserted, and will not be caused to rotate out of the blocking position by force from the media stack. The normal force between media block 50 and block lever 52 is at an angle perpendicular to, or even slightly acute to the contact plane of media block 50 and the outer radius of block lever 52. Pushing media more firmly against barricade 54 simply forces edge 84 against down guide 32. Media block 50 is thereby effectively rigid, and prevents the media stack from being inserted past the predetermined stop point defined by barricade 54.

During paper pick and delivery, automatic document feeder 12 operates such that feed roll shaft 42 moves in a clockwise direction as viewed from FIG. 1. From the position shown in FIG. 1, feed roll shaft 42 rotates in a clockwise direction, causing clockwise rotation of media block lever 52. Media block 50 is thereby caused to rotate in a counterclockwise direction on pivots 58 and 60 as cam follower 82 rides along cam surface 80 of leg 78. Block 50 rotates until barricade 54 nestles into recess 66, slightly behind the front surface of paper dam 26. Timing of system operation is geared in such a way that barricade 54 moves to the retracted position illustrated in FIG. 2 before the pick mechanism (not shown) begins to move media in the stack. The media is thereby fed unabated into the delivery system after barricade 54 has been retracted.

Much as described previously for the operation in which barricade 54 is moved to a blocking position, rotation of block lever 52 continues until an opposite edge 86 of collar 70 comes into contact with down guide 32, as shown in FIG. 2. Further rotation of block lever 52 is inhibited, and barricade 54 remains in the retracted position illustrated in FIG. 2.

In the third condition described earlier herein, paper feed and exit, operation leads to the first condition and operates on forward motion of the motor. From the position shown in FIG. 2, feed roll shaft 42 rotates in a counterclockwise direction, block lever 52 rotates in a counterclockwise direction along with feed roll shaft 42, and media block 50 rotates in a clockwise direction. Barricade 54 is moved from the retracted position within recess 66 to the blocking position again as illustrated in FIG. 1. If media remaining in input tray 18 has shingled toward paper dam 26 during the previous paper pick operation, as barricade 54 rotates to its blocking position from the retracted position the forwardly shingled media is returned to the original preferred position, with all media pieces re-aligned in the stacked position. Thus, media block apparatus 10 of the present invention returns all remaining sheets to the preferred position for subsequent pick, and subsequent picks are performed with sheets in the desired position for proper feed through automatic document feeder 12. Since, during the paper feed and exit condition, a tail of a single sheet of media still being fed out of input tray 18 may be present, to prevent media block 50 from impacting the motion of a piece of media being fed, the height of a media block 50 should be selected such that it does not interfere with media moving through the system.

With a sufficiently strong interference fit between collar 70 and feed roll shaft 42, the use of spring 72 and washers 74 and 76 are not required. Block lever 52 will rotate with feed roll shaft 42 until collar 70 thereof abuts downguide 32, interrupting further movement of block lever 52. Feed roll shaft 42 simply continues to rotate, as necessary, in collar 70.

In yet a further embodiment, block lever 52 can be of molded plastic with an integral spring structure molded therewith. Thus, a separate, independent spring 72 and washer 74 are not required.

The present invention provides a media block apparatus that is robust, yet simple. The apparatus has few parts, and mis-positioning resulting from tolerance stack-up is minimal. The apparatus provides a firm stop location for media inserted into an input tray. As individual pieces of media are removed from the input tray, the present invention realigns sheets as necessary, which may have advanced forwardly from the preferred stacked position.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An automatic document feeder for a media processing device, comprising:

a feed roll assembly including a feed roll shaft and feed rolls thereon;

a media input tray for holding media to be printed, said input tray having a discharge end from which media held therein is removed for processing; and a media block apparatus, including;

a media block having a barricade operable in said input tray, and selectively positionable in blocking and retracted positions in said tray; and a block lever drivingly connected to said feed roll assembly and engaged with said media block for moving said barricade between said blocking and retracted positions; and said block lever having a collar disposed on said feed roll shaft.

2. The automatic document feeder of claim 1, said collar having an inner diameter and said feed roll shaft having an outer diameter selected for establishing a driving connection between said block lever and said feed roll shaft by an interference fit of said collar on said shaft.

3. The automatic document feeder of claim 1, said collar having ends adapted to engage fixed structure in said feeder to stop further rotation of said block lever.

4. The automatic document feeder of claim 1, said collar disposed on said shaft between adjacent feed rolls, and a spring disposed on said shaft between one of said feed rolls and said collar.

5. The automatic document feeder of claim 4, said spring being integral with said collar.

6. An automatic document feeder for a media processing device, comprising:

a feed roll assembly including a feed roll shaft and feed rolls thereon;

a media input tray for holding media to be printed, said input tray having a discharge end from which media held therein is removed for processing; and a media block apparatus, including;

a media block having a barricade operable in said input tray, and selectively positionable in blocking and retracted positions in said tray; and a block lever drivingly connected to said feed roll assembly and engaged with said media block for moving said barricade between said blocking and retracted positions; and said media input tray including a media dam at said discharge end, said media dam having a recessed area therein and said barricade adapted to be moved into said recessed area in said retracted position.

7. The automatic document feeder of claim 6, said media block including an arm joined to said barricade and engaged with said block lever.

8. The automatic document feeder of claim 7, said media block having pivots on opposite sides of said barricade.

9. The automatic document feeder of claim 8, said block lever having a cam and said arm having a cam follower engaged with said cam.

10. The automatic document feeder of claim 6, said media block including an arm joined to said barricade and engaged with said block lever.

11. The automatic document feeder of claim 10, said block lever having a cam and said arm having a cam follower engaged with said cam.

12. A media blocking apparatus, for an input tray of an automatic document feeder in a media processing device, the document feeder including at least one feed roll on a feed roll shaft, said block apparatus comprising;

a media block operable in the input tray, said media block adapted for movement between blocking and retracted positions in said tray; and a block lever drivingly connected to the feed roll shaft and said media block for moving said media block between said blocking and retracted positions upon rotation of the feed roll shaft; and said block lever a cam and C-shaped collar held between adjacent feed rolls on the feed roll shaft,and said media block including a cam follower.

13. The media blocking apparatus of claim 12, said C-shaped collar forming an interference fit on the drive roll shaft.

14. A media blocking apparatus for an input tray of an automatic document feeder in a media processing device, the document feeder including at least one feed roll on a feed roll shaft, said block apparatus comprising;

a media block operable in the input tray, said media block adapted for movement between blocking and retracted positions in said tray; and a block lever drivingly connected to the feed roll shaft and said media block for moving said media block between said blocking and retracted positions upon rotation of the feed roll shaft; and said block lever including a collar disposed on the feed roll shaft.

15. The media blocking apparatus of claim 14, said block lever including a cam and said media block including a cam follower.

16. The media blocking apparatus of claim 14, said media block including a barricade and an arm angularly disposed relative to said barricade, and pivots on opposite sides of said block.

17. A media processing device, comprising:

a document feeder including a media input tray and a feed roll assembly;

a media block apparatus including a barricade adapted and arranged in said input try to move between blocking and retracted positions; and drive connection between said barricade and said feed roll assembly for moving said barricade between said blocking and retracted positions by rotation of said feed roll assembly;

said media block apparatus including a block lever rotated by said feed roll assembly, said block lever having a cam surface; and a block arm connected to said barricade having a cam follower engaged with said cam surface; and a down guide in said document feeder, and said block lever abutting said down guide when said barricade is at said blocking and retracted positions.

18. A media processing device, comprising:

a document feeder including a media input tray and a feed roll assembly;

a media block apparatus including a barricade adapted and arranged in said input try to move between blocking and retracted positions; and drive connection between said barricade and said feed roll assembly for moving said barricade between said blocking and retracted positions by rotation of said feed roll assembly;

said media block apparatus including a block lever rotated by said feed roll assembly, said block lever having a cam surface; and a block arm connected to said barricade having a cam follower engaged with said cam surface; and said feed roll assembly including a feed roll shaft and feed rolls thereon, and said block lever having a collar driven by said feed roll shaft.

19. The media processing device of claim 18, said feed roll assembly including a spring on said feed roll shaft, said spring biasing said collar between said feed rolls for driving rotation of said collar by rotation of said shaft.

20. A media processing device comprising:

a document feeder including a media input tray and a feed roll assembly;

a media block apparatus including a barricade adapted and arranged in said input try to move between blocking and retracted positions; and drive connection between said barricade and said feed roll assembly for moving said barricade between said blocking and retracted positions by rotation of said feed roll assembly; and said media input tray having a paper dam and a recess formed in said paper dam for receiving said barricade in said retracted position.

* * * * *